US008067683B2

(12) United States Patent
Meeks et al.

(10) Patent No.: US 8,067,683 B2
(45) Date of Patent: Nov. 29, 2011

(54) METHOD AND APPARATUS FOR ELECTRONICALLY SUSTAINING A NOTE FROM A MUSICAL INSTRUMENT

(75) Inventors: Timothy E Meeks, Havre de Grace, MD (US); Graham P Eatwell, Annapolis, MD (US)

(73) Assignee: Marcodi Musical Products, LLC, Baltimore, MD (US)

( * ) Notice: Subject to any disclaimer, the term of this patent is extended or adjusted under 35 U.S.C. 154(b) by 148 days.

(21) Appl. No.: 12/584,323

(22) Filed: Sep. 3, 2009

(65) Prior Publication Data

US 2009/0320671 A1 Dec. 31, 2009

Related U.S. Application Data

(63) Continuation-in-part of application No. 11/737,377, filed on Apr. 19, 2007, now Pat. No. 7,598,450.

(51) Int. Cl.

| | |
|---|---|
| ***G10H 1/06*** | (2006.01) |
| ***G10H 1/08*** | (2006.01) |
| ***G10H 7/00*** | (2006.01) |

(52) U.S. Cl. ..... 84/622; 84/604; 84/625

(58) Field of Classification Search ..... 84/604–607, 84/622, 625, 626, 659, 660, 662, 692, 697, 84/701, 726, 735, 737, 738, DIG. 10; 381/61, 381/62, 97–109, 118, 119, 120, 122, 124
See application file for complete search history.

(56) References Cited

U.S. PATENT DOCUMENTS 4,130,043 A 12/1978 Niimi

OTHER PUBLICATIONS

Boss RC-20XL Phrase Recorder Owner's Manual. 2004.*
Roland VG-99 V-Guitar System Owner's Manual, Oct. 1, 2007. Roland Document Reference: 04567023 07-02-4N.
Roland VG-99 V-Guitar System brochure. Dated Jun. 2007.
"Plucked String Models: From the Karplus-Strong Algorithm to the Digital Waveguides and Beyond". Karjalainen et al, Reprint of article published in the Computer Music Journal, 22:3, pp. 17-23, Fall 1998.

* cited by examiner

*Primary Examiner* — Jeffrey Donels
*Assistant Examiner* — Andrew R Millikin

(57) ABSTRACT

A sensed signal corresponding to a note played on a musical instrument is electronically sustained by electronically combining the sensed signal with a synthesized signal whenever a sustain control switch is activated. The set of characteristics of the synthesized signal are, initially, substantially the same as the set of characteristics of the sensed signal, but may be varied over time.

23 Claims, 12 Drawing Sheets

200

| | | | | | | | | | | | | | | | | | | | | | | | |
|---|---|---|---|---|---|---|---|---|---|---|---|---|---|---|---|---|---|---|---|---|---|---|---|
| A# | C | D | E | F# | G# | A# | C | D | E | F# | G# | A# | C | D | E | F# | G# | A# | C | D | E | F# | G# | A# |
| A | B | C# | D# | F | G | A | B | C# | D# | F | G | A | B | C# | D# | F | G | A | B | C# | D# | F | G | A |
| G# | A# | C | D | E | F# | G# | A# | C | D | E | F# | G# | A# | C | D | E | F# | G# | A# | C | D | E | F# | G# |
| G | A | B | C# | D# | F | G | A | B | C# | D# | F | G | A | B | C# | D# | F | G | A | B | C# | D# | F | G |
| F# | G# | A# | C | D | E | F# | G# | A# | C | D | E | F# | G# | A# | C | D | E | F# | G# | A# | C | D | E | F# |
| F | G | A | B | C# | D# | F | G | A | B | C# | D# | F | G | A | B | C# | D# | F | G | A | B | C# | D# | F |
| E | F# | G# | A# | C | D | E | F# | G# | A# | C | D | E | F# | G# | A# | C | D | E | F# | G# | A# | C | D | E |
| D# | F | G | A | B | C# | D# | F | G | A | B | C# | D# | F | G | A | B | C# | D# | F | G | A | B | C# | D# |
| D | E | F# | G# | A# | C | D | E | F# | G# | A# | C | D | E | F# | G# | A# | C | D | E | F# | G# | A# | C | D |
| C# | D# | F | G | A | B | C# | D# | F | G | A | B | C# | D# | F | G | A | B | C# | D# | F | G | A | B | C# |
| C | D | E | F# | G# | A# | C | D | E | F# | G# | A# | C | D | E | F# | G# | A# | C | D | E | F# | G# | A# | C |
| B | C# | D# | F | G | A | B | C# | D# | F | G | A | B | C# | D# | F | G | A | B | C# | D# | F | G | A | B |
| A# | C | D | E | F# | G# | A# | C | D | E | F# | G# | A# | C | D | E | F# | G# | A# | C | D | E | F# | G# | A# |
| A | B | C# | D# | F | G | A | B | C# | D# | F | G | A | B | C# | D# | F | G | A | B | C# | D# | F | G | A |

*FIG. 2*

| | | | | | | | | | |
|---|---|---|---|---|---|---|---|---|---|
| F# | A# | D | F# | A# | D | F# | A# | D | F# |
| F | A | C# | F | A | C# | F | A | C# | F |
| E | G# | C | E | G# | C | E | G# | C | E |
| D# | G | B | D# | G | B | D# | G | B | D# |
| D | F# | A# | D | F# | A# | D | F# | A# | D |
| C# | F | A | C# | F | A | C# | F | A | C# |
| C | E | G# | C | E | G# | C | E | G# | C |
| B | D# | G | B | D# | G | B | D# | G | B |
| A# | D | F# | A# | D | F# | A# | D | F# | A# |
| A | C# | F | A | C# | F | A | C# | F | A |
| G# | C | E | G# | C | E | G# | C | E | G# |
| G | B | D# | G | B | D# | G | B | D# | G |
| F# | A# | D | F# | A# | D | F# | A# | D | F# |
| F | A | C# | F | A | C# | F | A | C# | F |

METHOD AND APPARATUS FOR ELECTRONICALLY SUSTAINING A NOTE FROM A MUSICAL INSTRUMENT

CROSS REFERENCE TO RELATED APPLICATIONS

This application is a continuation in part of application Ser. No. 11/737,377, titled "Stringed Musical Instrument with Improved Method and Apparatus for Tuning and Signal Processing", filed 19 Apr. 2007.

FIELD

This invention relates generally to the field of stringed musical instruments.

BACKGROUND

In U.S. Pat. No. 4,530,268, Starrett describes a stringed musical instrument that embodies a matrix of intersecting frets and strings. Strings and frets are mounted in an intersecting relationship on a generally rectangular fingerboard. The strings are tuned by string tensioning means, including tuning pins or pegs. The string vibrations are sensed by a magnetic pickup and the resulting signal is amplified by an amplifier. The strings and frets each define a number of notes, equal to at least the number of notes of an octave. The instrument is played by depressing a string into contact with a fret. This action is called 'fretting' the strings. In a first scheme of modulation, multiple strings may be played along a single fret in a manner similar to a piano. In a second scheme of modulation, different frets are played to obtain different notes, as in a guitar, to achieve a wide tonal range with easy fingering positions. Vertically adjustable magnetic pickups sense the vibrations and are able to change the vibration sensitivity of the instrument.

At least thirteen strings are used to represent an octave, each string being separated by a semitone from the next adjacent string. Similarly, the frets intersecting a given string ascend in semitones for an octave. The strings are passed across a bridge and are secured to the fingerboard by appropriate tensioning means. Adjustment of the string tension is used to provide various temperaments.

One disadvantage of the Starrett instrument is that to play an octave interval using the first modulation scheme requires that thirteen strings be spanned. Starrett discloses an octave span that is the same distance as an octave span on a piano. Anthropometrical analysis will reveal that intervals much larger than this would be a difficult stretch from thumb to little finger of the same hand. It would therefore be difficult to play intervals much larger than an octave with one hand. In particular, it would be difficult to play 'open-voiced' chords that span large overall intervals (such as the greater-than two-octave chords playable on a guitar) with one hand. Moreover, among all possible equal-temperament tuning systems, Starrett's semitone tuning system requires the largest number of strings when matching the complete note range of another instrument such as guitar or piano. More strings result in higher cost, a larger and heavier instrument, and longer tuning time.

A still further disadvantage is that the instrument is heavy and difficult to carry, since it has a larger number of strings and a larger body compared to other stringed instruments (such as electric guitar).

A still further disadvantage is that notes cannot be sustained after finger removal (using a sustain pedal for example), since the fret selection is lost when a finger is removed from a string.

A still further disadvantage is that when a finger is lifted from a string, open strings may be plucked or sounded unintentionally.

A still further disadvantage is that strings used for the highest notes must be of smaller cross-sectional diameter than those for the lowest notes and consequentially produce weaker vibration signals. While Starrett's variable-distance magnetic pickups help to compensate for this, by bringing certain magnets within closer proximity to their respective strings, such compensation is limited by the adverse effects of increased magnetic pull on the strings (loss of sustain, for example).

A further disadvantage is that the use of magnetic pickups requires the use of metal strings, which can be uncomfortable to play. Additionally, magnetic pickups are commercially packaged in groups of four or six with predetermined spacing that is dissimilar from Starrett's spacing and not adjustable.

BRIEF DESCRIPTION OF THE DRAWINGS

The novel features believed characteristic of the invention are set forth in the appended claims. The invention itself, however, as well as the preferred mode of use, and further objects and advantages thereof, will best be understood by reference to the following detailed description of an illustrative embodiment when read in conjunction with the accompanying drawing(s), wherein:

FIG. 2 is a table showing an exemplary tuning system for strings in a first region of a musical instrument consistent with certain embodiments of the invention.

DETAILED DESCRIPTION

Figure 1:
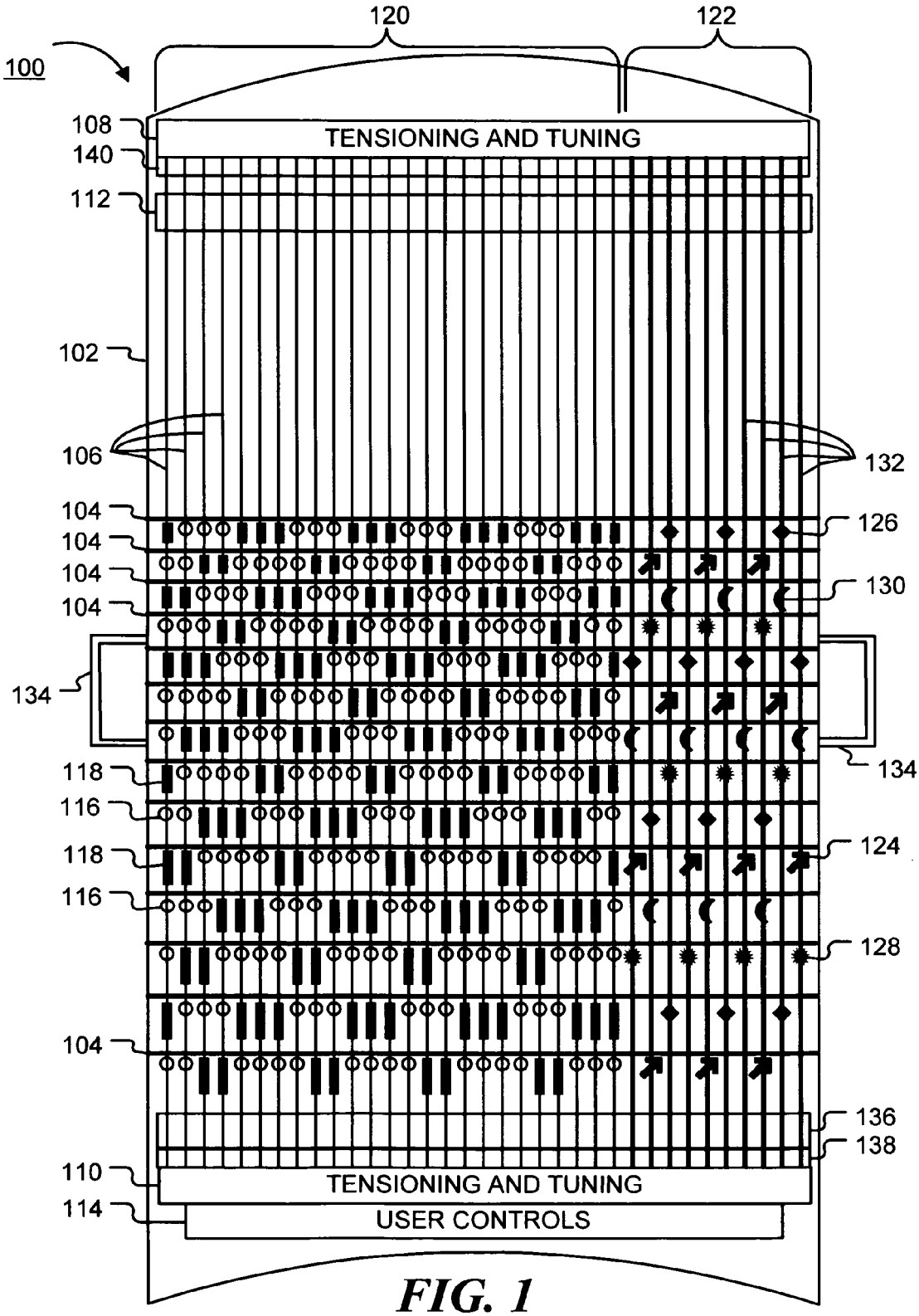
FIG. 1 is a diagrammatic representation of a musical instrument consistent with certain embodiments of the invention.

While this invention is susceptible of embodiment in many different forms, there is shown in the drawings and will herein be described in detail one or more specific embodiments, with the understanding that the present disclosure is to be considered as exemplary of the principles of the invention and not intended to limit the invention to the specific embodiments shown and described. In the description below, like reference numerals are used to describe the same, similar or corresponding parts in the several views of the drawings.

An exemplary musical instrument consistent with certain aspects of the present invention is shown in FIG. 1. Referring to FIG. 1, the instrument 100 comprises a fretboard 102 that supports a number of transverse frets 104. A plurality of strings 106 are stretched across the fretboard 102 above the frets 104. In one embodiment, at least 10 strings are used. The strings 106 are held in tension by tensioning assemblies 108 and 110. Either assembly 108 or assembly 110, or both assemblies 108 and 110, allow a user to adjust the tension in each string to allow the instrument 100 to be tuned. In addition, in accordance with one embodiment of the invention, either assembly 108 or assembly 110, or both assemblies 108 and 110, allow a user to adjust the tension in multiple strings at the same time. A tensioning assembly may include elements that are commonly used to adjust tension in other stringed musical instruments, such as pianos, guitars, violins etc. For example, the tension may be increased by winding the string onto a spindle (such as a piano pin or peg) or by linearly adjusting the position of one end of the string (using a screw for example).

Vibration of the strings 106 is sensed by a plurality of pickups 112. These may be magnetic pickups, as found in electric guitars for example, piezo-electric pickups, as used to amplify some acoustic guitars, optical pickups or other pickups that produce a signal in response to vibration of one or more strings. The use of piezo-electric or optical pickups allows non-ferrous strings (such as nylon strings) to be used.

The signals from the plurality of pickups 112 may be passed through signal conditioning circuits, amplified and used to drive one or more acoustic transducers to produce sound.

In accordance with one aspect of the present invention, adjacent strings 106 are tuned to whole tone intervals in a first region 120. This is in contrast to previous tuning systems in which adjacent strings were tuned to semitone intervals. Thus, a musical octave spans just seven strings. Choosing Starrett's string spacing, as an example, a user is now able to span twice the musical interval of Starrett's instrument with one hand. Moreover, matching the overall note range of Starrett's instrument requires only half the number of strings, reducing size, cost and weight.

A hereby disclosed compromise to Starrett's octave span and associated string spacing would be a span which reduces said string spacing to the greatest extent while still allowing four tightly aligned fingertips of one hand to effectively play four adjacent strings along a particular fret. This compromise would result in a string spacing similar to the width of a human fingertip, whereby thirteen strings (an octave span on the Starrett instrument) would span a distance of approximately twelve fingertip widths. Even so, anthropometrical analysis will still reveal that intervals much larger than twelve fingertip widths would be a difficult stretch from thumb to little finger of the same hand. So even a Starrett instrument with minimized string spacing would have the disadvantage of not facilitating the playing of chords with an overall interval of greater-than-two octaves (such as those playable on a guitar) with one hand.

In the present invention, string intervals may ascend from left to right (as on a piano) or from right to left. Alternatively, different regions of strings may ascend in different directions. For example, strings may ascend from the center of the instrument towards each side so that the thicker strings are nearest the thumbs and the thinnest strings are nearest the little fingers. Such an example also exploits the benefits of muscular symmetry as musical patterns could be played with either hand using the same muscular motions.

In accordance with some embodiments of the present invention, the fretboard 102 is marked with a plurality of markers 116 and 118 in the first region 120 (the region which utilizes a whole tone tuning system). A marker may be a symbol, shape, indentation, raised area, color, light, or other identifying feature. The use of whole tone tuning system still allows a 'piano-like' marking scheme to be used. On a piano, the white keys produce the notes A through G, which are within the C major scale, while the black keys produce the notes C#, D#, F#, G# and A#, which are outside of the C major scale. The black keys appear in alternating clusters of two and three. In an embodiment of the present invention, notes outside of a particular major scale are still represented by alternating visual clusters of two and three common markers. It is noted that whole tone tuning and Starrett's semitone tuning are the only equal-temperament tuning systems which allow for this visual clustering. The visual clustering of common markers can become a crucial aid to players of the instrument 100 who are familiar with piano, organ or other keyboard instruments. The whole tone tuning of the present invention may be such that the notes with common markers correspond to notes outside of the C major scale or to notes outside of any other selected major scale. In FIG. 1, the markers 116 indicate that fretting the string at that position will generate a note within a particular major scale. The markers 118 indicate that fretting the string at that position will generate a note outside of that same major scale. It will be apparent to those of ordinary skill in the art that markers other than circles and rectangles may be used (all circles for example), and colors other than black and white may be used. It will be further apparent that marking only notes within or only notes outside of a particular major scale can still provide a useful visual aid for those players familiar with keyboard instruments. Moreover, it will be apparent that an assigned attribute (such as color) can suffice as the marker for notes within a particular major scale, and a differently-assigned attribute (such as a different color) can suffice as the marker for notes outside of the same major scale, still achieving the useful visual aid regardless of other varying attributes (such as shape). As an example of this, each note name could be assigned its own unique marker shape (as a further identification aid), with notes within a particular major scale displayed in white and notes outside of same major scale displayed in black.

Another alternative tuning system is one that creates a diatonic scale along any fret. This requires a combination of whole tone and semitone intervals between adjacent strings and could conveniently mimic the white keys (notes within the scale of C major) of a piano on at least one fret. While this may be a particular convenience, there are two notable disadvantages with a diatonic tuning system. First, the visual pattern of markers which denote inclusion or exclusion from a particular major scale has a far less regular repetition of visual 'cues' and hence note identification requires intensive memorization. Second, chord and scale shapes cannot be maintained when shifting from left to right or vice versa since adjacent strings are not all tuned to the same interval. Consequently, muscle memory cannot be utilized to the degree it can for a regular tuning system such as whole tone.

In accordance with some embodiments of the present invention, adjacent strings 132 are tuned to double whole tone intervals in a second region 122. This allows the instrument to be played in a manner similar to a guitar (for example by strumming). An interval of double whole tones is equal to a major third interval. Since many common chords are comprised of one or more third or near-third intervals (minor thirds or fourths, for example), this facilitates playing a series of adjacent strings within a small range of frets to form a chord. Within a whole tone or semitone tuning system, intermediate strings would too often need to be muted, resulting in discontinuous strums and arpeggios.

In accordance with some embodiments of the present invention, the fretboard 102 is marked with a plurality of markers (124, 126, 128 and 130) in the second region 122 (the region which utilizes a double whole tone tuning system). Each marker corresponds to a note name. For example, in one embodiment the arrow 124 denotes the note A, the diamond 126 denotes the note D, the gear 128 denotes the note G, and the crescent 130 denotes the note C. In this example, marker names are chosen such that their initial letters are equal to the desired note name. Further in this example, not all note names have assigned markers, but those that do are marked wherever they occur in the second region 122 of strings. Other markers, such as the note names themselves, may be used as alternatives.

The markers may be applied to the surface of the fretboard 102, inlaid into the fretboard or placed below a transparent fretboard.

The musical instrument may be provided with carrying handles 134 to facilitate moving the instrument. The carrying handles 134 may be fixed, or may fold away when not in use and may be placed near the center of gravity of the instrument. Alternatively, handles may be formed by removing material from the body of the instrument 100 to form recesses for hand placement.

The instrument may be supported by a stand or a table. Alternatively, the instrument may be supported by legs that attach to the underside of the instrument. It will be apparent to those of ordinary skill in the art that support mechanisms commonly used for supporting keyboard instruments may be used.

The fretboard 102 may be constructed of a natural material, such as wood, or of a synthetic material, such as carbon fiber. Synthetic materials may be used to reduce the weight. A combination of materials may also be used. For example, a carbon-fiber frame may be used to provide stiffness to resist the tension in the strings and a wooden playing surface may be attached to the frame.

At the playing end of the instrument, the strings pass over a felt pad 136 and are supported above the fretboard 102 by a nut 138. The felt pad serves to dampen unintentional vibration of the unfretted strings (string not in contact with a fret). At the other end of the instrument, the strings are supported above the fretboard 102 by a bridge 140.

FIG. 2 is a table showing an exemplary tuning system for those strings in the first region. Each column of the table lists the notes obtained by playing a single string at different fret positions. Each row of the table lists the notes obtained by playing different strings at the same fret position. Adjacent columns correspond to adjacent strings and show that adjacent strings are tuned to whole tone intervals. The number of strings and/or frets may be varied.

Figures 3, 4:
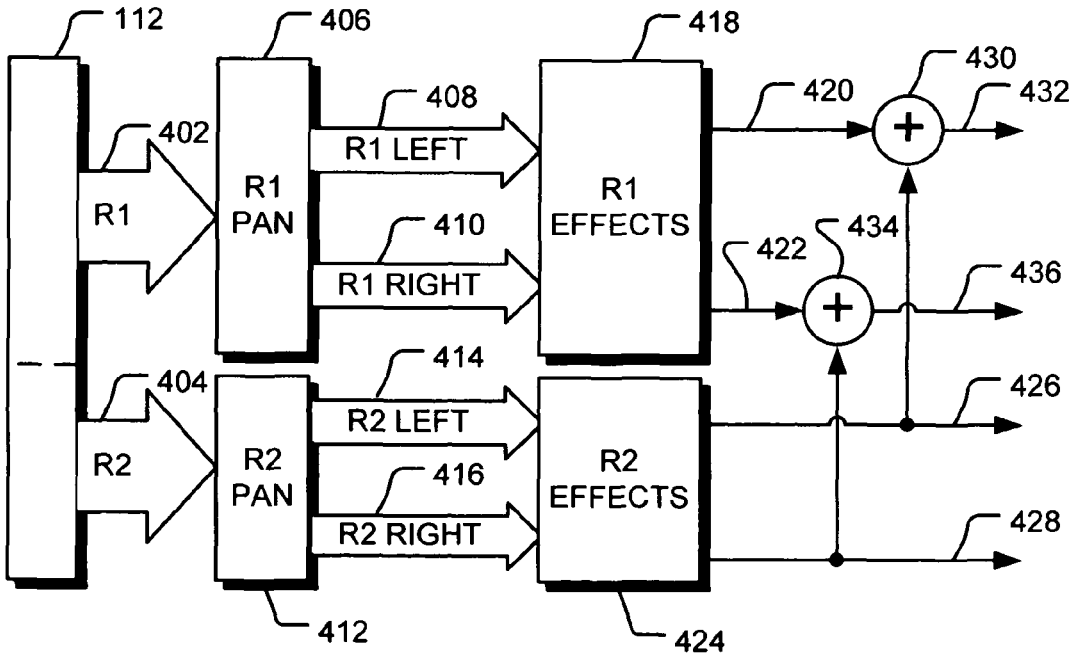
FIG. 3 is a table showing an exemplary tuning system for strings in a second region of a musical instrument consistent with certain embodiments of the invention.
FIG. 4 is a block diagram of an exemplary panning and signal processing circuit in accordance with some embodiments of the invention.

FIG. 3 is a table showing an exemplary tuning system for those strings in the second region. Each column of the table lists the notes obtained by playing a single string at different fret positions. Each row of the table lists the notes obtained by playing different strings at the same fret position. Adjacent columns correspond to adjacent strings and show that adjacent strings are tuned to double whole tone intervals. The number of strings and/or frets may be varied.

FIG. 4 is a block diagram of an exemplary signal processing circuit in accordance with some embodiments of the invention. Referring to FIG. 4, the pickup assembly 112 produces a plurality of output signals that are grouped as signals 402 and 404. In one embodiment, the signals 402 are from the first region of the musical instrument (whole tone tuning system) and the signals 404 are from the second region (double whole tone tuning system). However, the signals may be collected in any number of groups. For example, the signals from the first region could be collected into high and low frequency groups, giving a total of three groups. For simplicity, only two groups are shown in the figure. In this embodiment, the group of signals 402 is passed through a panning circuit 406. The signals are level adjusted, in accordance with a first set of signal weightings, and summed to produce a left channel signal 408. The signals are level adjusted, in accordance with a second set of signal weightings, and summed to produce a right channel signal 410. As is well known to those of ordinary skill in the art, the relative levels of a given signal in the left and right channels determines the apparent source of the sound when reproduced by a stereo audio system. For example, lower frequency strings could be placed further to the left and higher frequency strings placed further to the right, or vice versa. The signal weightings may also be varied in time to give an impression of a sound source moving with time.

Similarly, the group of signals 404 is passed through a panning circuit 412. The signals are level adjusted, in accordance with a third set of signal weightings, and summed to produce a left channel signal 414. The signals are level adjusted, in accordance with a fourth set of signal weightings, and summed to produce a right channel signal 416.

The signals 408 and 410 are passed through a first effects processor 418 that is operable to modify the signals to produce various stereo effects, such as reverberation, delay, distortion, chorus, tremolo, etc. The modified left and right channel signals, 420 and 422 respectively, are output. Similarly, the signals 414 and 416 are passed through a second stereo effects processor 424 to produce modified left and right channel signals, 426 and 428 respectively as outputs.

Finally, the outputs from the different regions may be combined. For example, the left channel output signals 420 and 426 are combined in signal summer 430 to produce the final left channel output signal 432, and the right channel output signals 422 and 428 are combined in signal summer 434 to produce the final left channel output signal 436. The inclusion or exclusion of summers 430 and 434 may be determined via a user interface. Thus, the stereo outputs from the different regions may be output in combination or separately. Signals 432 and 436 may be passed to sound amplification equipment or recording equipment. The output signals 420, 422, 426 and 428 may also be output to a digital signal processor or other electronic circuits to allow for further processing. In a further embodiment, summers 430 and 434 are replaced with mixers to control the mixing of signals 420 and 426 and signals 422 and 428.

The panning circuits 406 and 412 and/or the effects processors 418 and 424 may be integrated into the body of the musical instrument and may be implemented using a digital signal processor (DSP).

In one embodiment, the instrument is provided with an AC/DC power supply. In a further embodiment, the instrument is powered using one or more batteries. In a still further embodiment, when no signal processing is used, the instrument is not powered.

In some embodiments of the invention, each string has its own pickup that senses vibration of the string with little or no interference from the vibration of other strings. The pickup may be a piezo-electric pickup for example.

A plurality of amplifiers may be used to adjust the levels of the signals produced each pickup independently, so as to compensate for the effect of string gauge on vibration signal level, or for the manufacturing variability of pickup sensitivity. Similarly, a plurality of equalization circuits may be used to adjust, independently, the equalization of the signals produced by each pickup. In this way, a user has control of the sound produced by each individual string.

Figure 5:
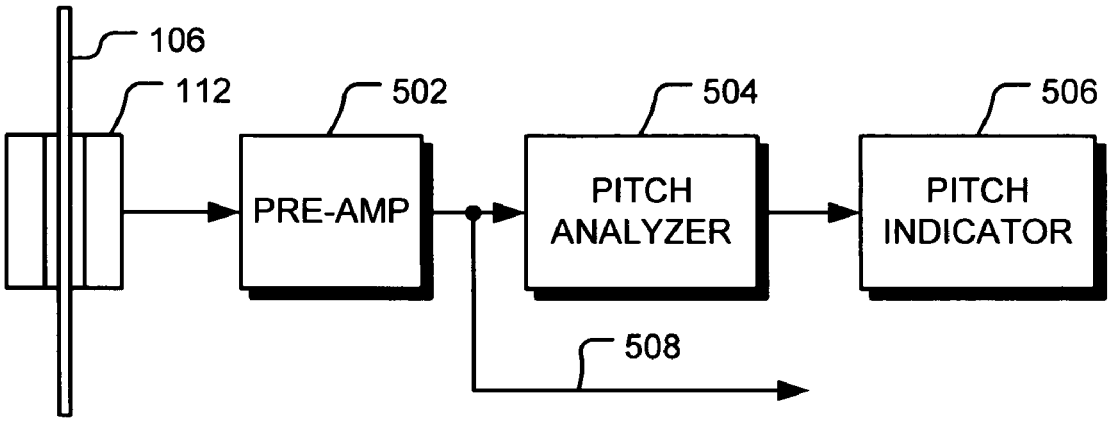
FIG. 5 is a block diagram of an exemplary signal processing circuit, in accordance with some embodiments of the invention, to aid in the tuning of a stringed musical instrument.

FIG. 5 is a block diagram of a musical instrument signal processing circuit consistent with certain embodiments of the invention. Referring to FIG. 5, a pickup 112 (such as a piezoelectric or optical pickup) senses motion of a string 106 of the musical instrument. The signal from the pickup is passed to a pre-amplifier 502 and then to a pitch analyzer 504. The pitch analyzer 504 is operable to determine the relationship between the frequency of oscillation of the string 106 (the pitch of the note produced) and a selected ideal frequency. A pitch indicator 506 provides a visible or audible feedback to the user. In one embodiment the indicator is a meter. In a further embodiment the indicator is accomplished with one or more lights, such as Light Emitting Diodes (LED's). The lights may show when the string is tuned within a specified range, or when it is outside of the range. For example, a light of a first color may be illuminated if the pitch of the string is above the specified range and a light of a second color may be illuminated if the pitch of the string is below the specified range. The signal processing system may be integrated into the musical instrument and may be enabled and disabled by a user. The ideal frequency may correspond to the desired frequency of the string at a specified or predetermined fret position (such as the first fret). The amplified output 508 from the pre-amplifier is provided as an output for further signal processing.

Multiple strings may share a single pitch analyzer and/or pitch indicator. A processor may detect automatically which string has been played (by comparing amplitudes and/or frequencies for example) or the user may use a selector to indicate which string is to be tuned. In a further embodiment, the instrument may detect which string is making contact with which fret.

Figure 6:
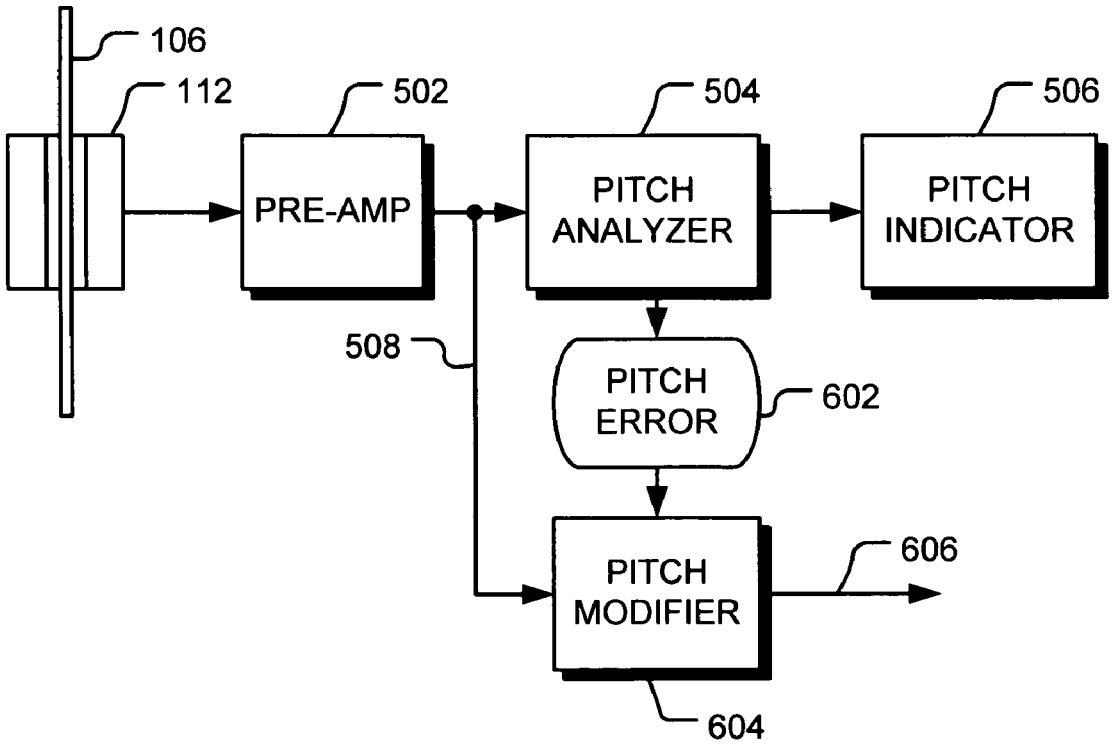
FIG. 6 is a block diagram of a further exemplary signal processing circuit, in accordance with some embodiments of the invention, for electronically tuning a stringed musical instrument.

A further embodiment of a signal processing system is shown in FIG. 6. In this embodiment, a relative error between the pitch of a string 106 (at a specified of predetermined fret position) is determined by pitch analyzer 504 while the musical instrument is in a calibration mode. The relative error is stored in memory 602. During normal operation of the musical instrument, the amplified output 508 is passed to pitch modification circuit 604 that modifies the pitch according to the relative error and provides a pitch-modified signal 606 as output. For example, if the pitch of the string is 1% too high, the pitch modifier shifts the signal down in frequency by 1%. In one embodiment, multiple strings may share a single pitch analyzer but individual pitch modifiers are used for each string.

Figure 7:
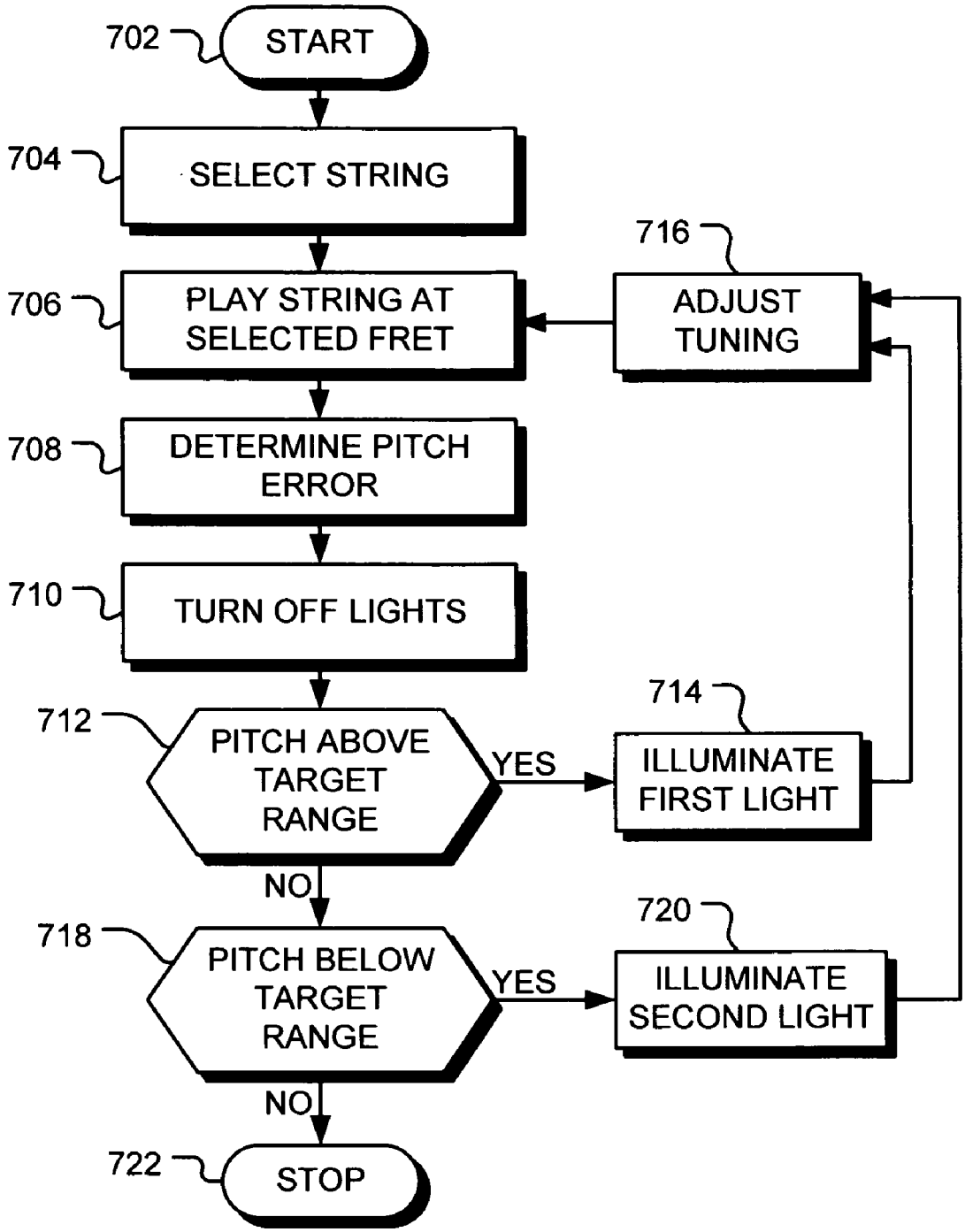
FIG. 7 is a flow chart of a method, in accordance with certain embodiments of the invention, for indicating the tuning accuracy of a stringed musical instrument.

FIG. 7 is a flow chart of a method for indicating pitch accuracy in accordance with certain embodiments of the invention. Following start block 702 in FIG. 7, the user selects a string of the musical instrument to be tuned at block 704. At block 706, the user plays the selected string, either by pressing it down (tapping) so that comes into contact with a fret or by holding the string down in contact with the fret and then plucking it. At block 708, the signal processing system determines the pitch error between the ideal frequency of the string when played at the selected fret and the actual frequency as determined by analyzing the signal from the pickup associated with the string. In this embodiment, the pitch indicator comprises two indicator lights, such as light emitting diodes. At block 710, the indicator lights are switched off. At decision block 712 it is determined if the frequency of the played string is above a specified range that includes the ideal frequency. If so, as depicted by the positive branch from decision block 712, the first indicator light is illuminated at block 714. This indicates to the user that the pitch of the string is to be lowered and the user adjusts the tuning at block 716. If the frequency is not above the range, as depicted by the negative branch from decision block 712, flow continues to decision block 718, where it is determined if the frequency of the played string below the specified range that includes the ideal frequency. If so, as depicted by the positive branch from decision block 718, the second indicator light is illuminated at block 720. This indicates to the user that the pitch of the string is to be raised and the user adjusts the tuning at block 716. If the frequency is not below the range, as depicted by the negative branch from decision block 718, the tuning process is complete and terminates at block 722. The first and second lights may be different colors. For example, the first light may be red and the second light blue. A third light may be added that is illuminated when the frequency of the string is within the specified range.

Figure 8:
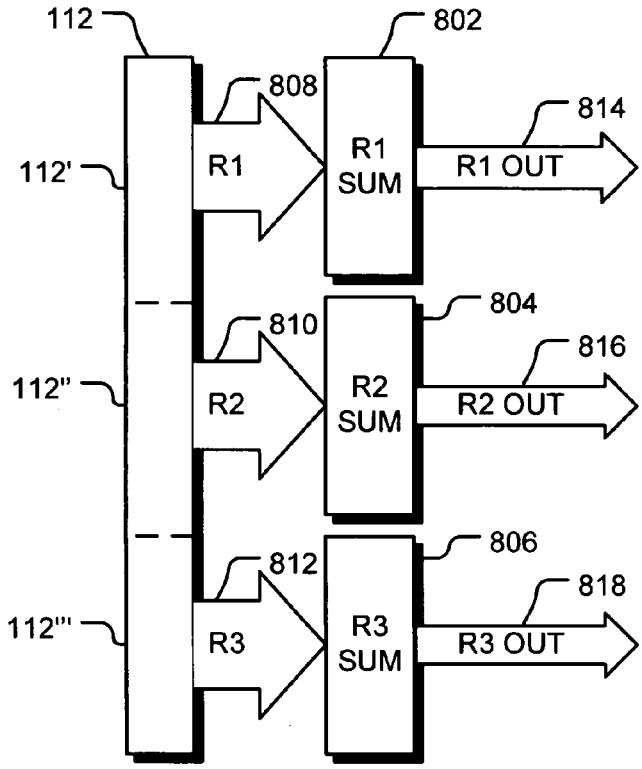
FIG. 8 is a block diagram of an exemplary signal summing circuit for a musical instrument consistent with certain embodiments of the invention.

FIG. 8 is a block diagram of an exemplary signal processing system for a musical instrument consistent with certain embodiments of the present invention. The signal processing system includes a plurality of summing circuits, each operable to sum a subset of the signals from the pickups 112 to produce a summed signal as output. In the embodiment shown in FIG. 8, there are three summing circuits, 802, 804 and 806. Summing circuit 802 receives signals 808 from a first subset 112' of pickups and produces an output signal 814 that is a combination of the input signals 808. Similarly, summing circuit 804 receives signals 810 from a second subset 112" of pickups and produces an output signal 816 that is a combination of the input signals 810 while summing circuit 806 receives signals 812 from a third subset 112''' of pickups and produces an output signal 818 that is a combination of the input signals 812. The output signals 814, 816 and 818 may be processed further as independent signals or may be mixed prior to further processing.

Figure 9:
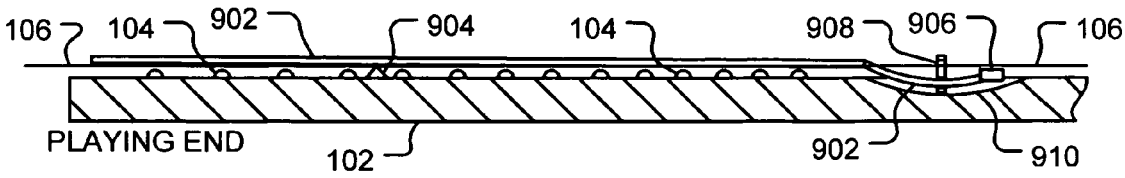
FIG. 9 is a cross-section through an exemplary musical instrument consistent with certain embodiments of the invention.

FIG. 9 is a cross-section through an exemplary musical instrument consistent with certain embodiments of the invention. Referring to FIG. 9, the fretboard 102 supports a number of frets 104 against which a string 106 can be fretted by a player of the instrument. In normal operation, a string, once played, will resonate with slowly decreasing amplitude until the player releases the string. In an alternative mode of operation, a player may activate a lever arm 902, by pressing the end of the lever arm that is on the side of a fulcrum 904 closest to the playing end of the fretboard 102. Activation of the lever arm 902 at the playing end causes the far end to rise. A dampening pad 906, made of a dampening material such as felt, is attached to the far end of lever arm (the end closest to the pickups) and is brought into contact with the underside of the string 106. This causes the vibration of the string 106 to decrease much more rapidly, resulting in a more 'staccato' note with different harmonic content. The dampening pad 906 may extend across one or more strings or may extend across all strings of the instrument. A 'U-shaped' guide 908 prevents excessive lateral motion of the lever arm 902. The lever arm 902 may be positioned between a pair of strings and the fulcrum 904 may be taller than the frets 104 so as to raise the lever arm above the frets. Alternatively, the lever arm may be activated by other mechanisms, such as a foot pedal or a switch that controls an electric motor. The foot pedal may be connected to the lever arm mechanically, or it may be an electrical or optical switch, for example.

Figure 10:
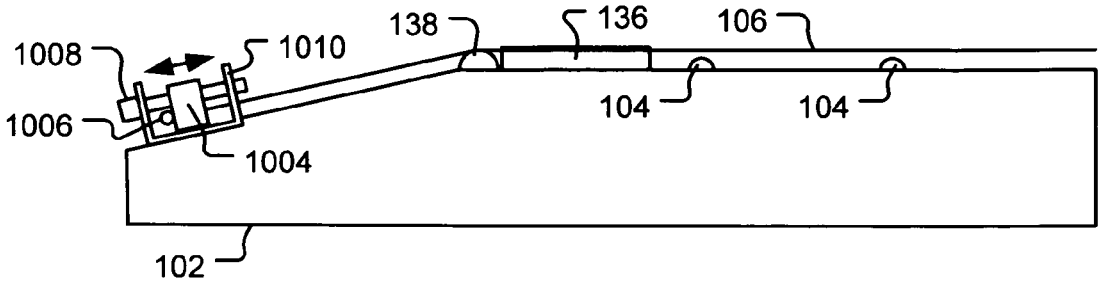
FIG. 10 is side view of a tuning mechanism in accordance with some embodiments of the invention.

FIG. 10 is a side view of the playing end of an exemplary musical instrument. The fretboard 102 supports frets 104. A nut 138 supports the strings 106 at the playing end. The string 106 passes over nut 138 and through string retainer block 1004. Each string is terminated with a ball end 1006 that prevents the string from sliding through the string retainer block 1004. Tuning screw 1008 passes through a U-channel support 1010. The string retainer block 1004 is threaded so that rotation of the tuning screw moves the string retainer block 1004 within the U-channel support 1010 to manipulate the tension in the string 106. Other mechanisms for adjusting the tension in a string will be apparent to those of ordinary skill in the art. Felt pad 136 dampens the vibration of the strings from nut 138 to selected fret for fretted strings or from nut 138 to the bridge for strings that are not fretted.

Figure 11:
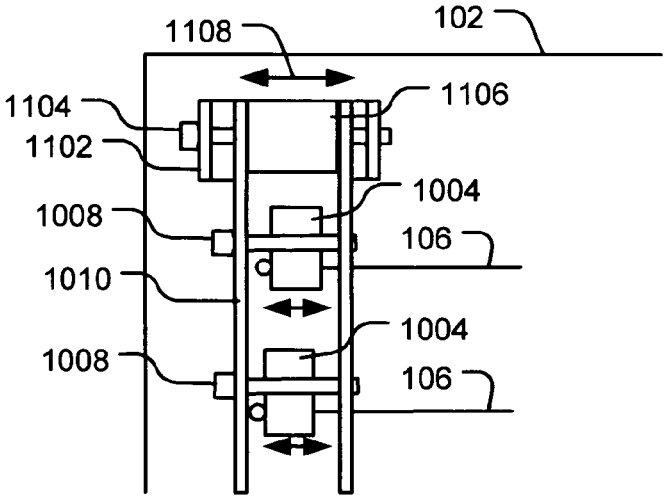
FIG. 11 is top view of a tuning mechanism in accordance with some embodiments of the invention.

FIG. 11 is a top view of a tuning mechanism in accordance with some embodiments of the invention. The mechanism is supported by the fretboard 102, and comprises U-channel 1010, string retainer blocks 1004 for strings 106 and individual tuning screws 1008. The mechanism also includes a first master tuning mechanism comprising U-bracket 1102, master tuning screw 1104 and master tuning block 1106. The master tuning block 1106 is attached to the U-channel 1010 and is threaded. When master tuning screw 1104 is turned, the master tuning block 1106 and the attached U-channel 1010 move backwards or forwards within U-bracket 1102 as indicated by arrow 1108. A second master tuning mechanism is positioned at the other end of the U-channel 1010. Together, the first and second master tuning mechanisms allow all of the strings 106 to be tuned together. This capability is useful for compensating for temperature changes, for example, which affect all strings in a similar manner.

In this example a 'sliding' master tuning mechanism is used, however it will be apparent to those of ordinary skill in the art that other tuning mechanisms may be used, including singular master tuning mechanisms near the center of U-channel 1010. For example, the tuning mechanism may use a modified U-Channel 1010 with pivoting action.

The occurrence of unintended open (unfretted) string plucks is reduced by using electrically conductive frets and strings to create a switching network which selectively mutes electronic signals downstream of the one or more pickups. In one embodiment of the invention, the frets are interconnected and carry, for example, a +1V DC electric potential. Whenever any string touches any fret, this +1V signal makes its way to an electrically conductive nut (that supports the strings at the playing end) or bridge (that supports the strings at the opposite end). This signal may be detected to indicate that at least one of the strings is being fretted. If no strings are fretted, outputs of the instrument are electronically muted, hence masking any open string vibrations.

In an alternative embodiment, the frets are interconnected and carry a +1V signal as described. Each string is isolated from the bridge, nut and U-channel using insulating isolators or a non-conductive bridge, nut and U-channel. The transfer of the electrical signal is then detected in each string independently. String signals are individually muted (electronically) when they do not carry the +1V potential. Un-muting begins once the string starts carrying the +1V potential again and this could be implemented as a time-varied signal ramp-up to vary the musical "attack" of each fretted note. This approach requires additional circuitry, but allows one string to be muted while other strings are being played. In a related embodiment, the strings are supplied with a voltage signal at one end. The voltage signal is shorted to ground if the string is fretted anywhere, and the string can be muted if the voltage signal is detected at the far end of the string. In all of the cases described above, the strings and frets form a fret contact circuit.

Figure 12:
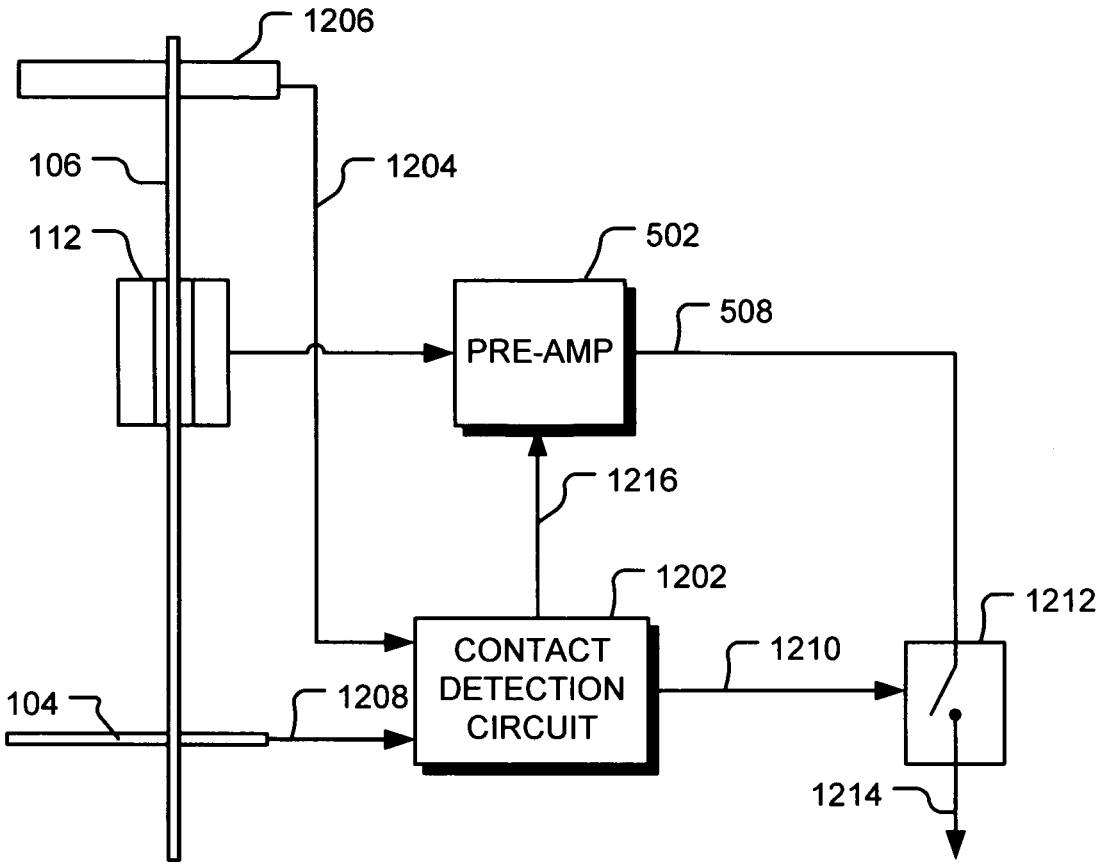
FIG. 12 is a block diagram of an electronic muting system in accordance with certain embodiments of the invention.

FIG. 12 is a block diagram of an electronic muting system in accordance with certain embodiments of the invention. Referring to FIG. 12, a contact detection circuit 1202 is electrically connected via conductor 1204 to an electrically conducting bridge 1206 that supports the strings, including string 106. The contact detection circuit 1202 is also connected to fret 104 via conductor 1208. In operation, the contact detection circuit 1202 detects when electrical contact is made between the string 106 and the fret 104. Both the string and the fret are electrically conducting. If no contact is detected, the switch control signal is used to control output-muting switch 1212 to an open position, thus preventing the sensed signal 508 from reaching output 1214. If contact is detected, the switch control signal is used to control output-muting switch 1212 to a closed position, allowing sensed signal 508 to reach output 1214.

In an alternative embodiment, the contact detection circuit 1202 generates a control signal 1216 to disable pre-amplifier 502 when no contact is detected. Thus the sensed signal is only amplified if contact is detected. Disabling the pre-amplifier 502 mutes the output signal 1212 and also serves to reduce power consumption by pre-amplifier 502. This latter feature is important when the instrument is operated using a battery power supply.

In one embodiment, the instrument is provided with a sustain effect. In this embodiment, when a sustain pedal is depressed, it triggers a DSP effect which determines which harmonics are being played (using Fourier analysis, for example) and synthesizes those harmonics. Alternatively, the sound is sampled and recorded and a periodic portion of the waveform is played out in a repetitive loop. The synthesized signal gradually replaces the actually sensed signal by blending or mixing the sensed signal and the synthesized signal. With the sustain pedal still depressed, a slowly decreasing amplitude envelope may be applied to the output signal to simulate a natural weakening of the vibration signal. Lifting the sustain pedal instantly cuts off the playback of synthesized waveforms. Alternatively, the sustained synthesized portion of the note could be gradually attenuated upon sustain pedal lift to emulate instruments with longer "Release" periods. Attack and release times may be varied by a user by use of parameter knob or other user interface. The attack and release times may be varied together by a single control, or separately.

In an alternative embodiment, a sustain effect is achieved using individual fretted/unfretted status of each string (as described above, using strings which are electrically isolated when unfretted). Each fretted string is assigned a permanent or real-time selected waveform generator, which is used to generate a synthetic version of the played note. The synthetic version may be achieved efficiently using a sample loop, for example. The synthetic sustain could also be equalized differently than the played note to provide tonal variety. Blending the synthesized sustain happens quickly once a note is played and the sustain pedal is depressed. Once in synthesis playback, a slowly decreasing amplitude envelope is applied to its waveform generator. Lifting the sustain pedal triggers the 'release' portion of the amplitude envelope.

TABLE 1

Sustain Pedal Functions.

| Time | Foot Pedal Pos. | Finger 1 Action | String 1 Vibration (SV1) | String 1 Fret Contact Circuit | SV1 Mute Function | Sampler Status | Output Signal |
|---|---|---|---|---|---|---|---|
| 1 | UP | (none) | (none) | OPEN | MUTED | STANDBY | MUTED |
| 2 | UP | FRET STRING 1 | ATTACK STAGE | CLOSED | UNMUTED | STANDBY | SV1 (UNMUTED) |
| 3 | UP | HOLD DOWN STRING 1 | DECAY STAGE | CLOSED | UNMUTED | STANDBY | SV1 (UNMUTED) |
| 4 | UP | HOLD DOWN STRING 1 | SUSTAIN STAGE | CLOSED | UNMUTED | STANDBY | SV1 (UNMUTED) |
| 5 | UP | LIFT OFF STRING 1 | RESIDUAL OPEN STRING VIBRATION | OPEN | MUTED | STANDBY | MUTED |
| 6 | UP | (none) | RESIDUAL OPEN STRING VIBRATION | OPEN | MUTED | STANDBY | MUTED |
| 10 | DOWN | (none) | (none) | OPEN | MUTED | RESET | MUTED |
| 11 | DOWN | FRET STRING 1 | ATTACK STAGE | CLOSED | UNMUTED | STANDBY | SV1 (UNMUTED) |
| 12 | DOWN | HOLD DOWN STRING 1 | DECAY STAGE | CLOSED | UNMUTED | STANDBY | SV1 (UNMUTED) |
| 13 | DOWN | HOLD DOWN STRING 1 | SUSTAIN STAGE | CLOSED | UNMUTED | SAMPLING | SV1 (UNMUTED) |
| 14 | DOWN | HOLD DOWN STRING 1 | SUSTAIN STAGE | CLOSED | UNMUTED | LOOP PLAY | GRADUAL BLEND FROM SV1 TO SAMPLER |
| 15 | DOWN | HOLD DOWN STRING 1 | SUSTAIN STAGE | CLOSED | UNMUTED | LOOP PLAY | SAMPLER |
| 16 | DOWN | LIFT OFF STRING 1 | RESIDUAL OPEN STRING VIBRATION | OPEN | MUTED | LOOP PLAY, | SAMPLER |
| 17 | DOWN | (none) | RESIDUAL OPEN STRING VIBRATION | OPEN | MUTED | LOOP PLAY | SAMPLER |
| 18 | DOWN | FRET STRING 1 | ATTACK STAGE | CLOSED | UNMUTED | RESET | SV1 (UNMUTED) |
| 19 | DOWN | HOLD DOWN STRING 1 | DECAY STAGE | CLOSED | UNMUTED | STANDBY | SV1 (UNMUTED) |
| 20 | DOWN | HOLD DOWN STRING 1 | SUSTAIN STAGE | CLOSED | UNMUTED | SAMPLING | SV1 (UNMUTED) |
| 21 | DOWN | HOLD DOWN STRING 1 | SUSTAIN STAGE | CLOSED | UNMUTED | LOOP PLAY | GRADUAL BLEND FROM SV1 TO SAMPLER |
| 22 | DOWN | HOLD DOWN STRING 1 | SUSTAIN STAGE | CLOSED | UNMUTED | LOOP PLAY | SAMPLER |
| 23 | DOWN | LIFT OFF STRING 1 | RESIDUAL OPEN STRING VIBRATION | OPEN | MUTED | LOOP PLAY | SAMPLER |
| 24 | DOWN | (none) | RESIDUAL OPEN STRING VIBRATION | OPEN | MUTED | LOOP PLAY | SAMPLER |

TABLE 1-continued

Sustain Pedal Functions.

| Time | Foot Pedal Pos. | Finger 1 Action | String 1 Vibration (SV1) | String 1 Fret Contact Circuit | SV1 Mute Function | Sampler Status | Output Signal |
|---|---|---|---|---|---|---|---|
| 25 | UP | (none) | (none) | OPEN | MUTED | LOOP PLAY, RELEASE STAGE | SAMPLER |
| 26 | UP | (none) | (none) | OPEN | MUTED | RESET | MUTED |
| 30 | UP | (none) | RESIDUAL OPEN STRING VIBRATION | OPEN | MUTED | STANDBY | SAMPLER |
| 31 | UP | FRET STRING 1 | ATTACK STAGE | CLOSED | UNMUTED | STANDBY | SV1 (UNMUTED) |
| 32 | UP | HOLD DOWN STRING 1 | DECAY STAGE | CLOSED | UNMUTED | STANDBY | SV1 (UNMUTED) |
| 33 | DOWN | HOLD DOWN STRING 1 | SUSTAIN STAGE | CLOSED | UNMUTED | SAMPLING | SV1 (UNMUTED) |
| 34 | DOWN | HOLD DOWN STRING 1 | SUSTAIN STAGE | CLOSED | UNMUTED | LOOP PLAY | GRADUAL BLEND FROM SV1 TO SAMPLER |
| 35 | UP | HOLD DOWN STRING 1 | SUSTAIN STAGE | CLOSED | UNMUTED | LOOP PLAY | SV1 (UNMUTED) |
| 36 | DOWN | HOLD DOWN STRING 1 | SUSTAIN STAGE | CLOSED | UNMUTED | LOOP PLAY | SAMPLER |
| 37 | DOWN | LIFT OFF STRING 1 | RESIDUAL OPEN STRING VIBRATION | OPEN | MUTED | LOOP PLAY | SAMPLER |
| 38 | DOWN | (none) | RESIDUAL OPEN STRING VIBRATION | OPEN | MUTED | LOOP PLAY | SAMPLER |
| 39 | UP | (none) | (none) | OPEN | MUTED | LOOP PLAY, RELEASE STAGE | SAMPLER |
| 40 | UP | (none) | (none) | OPEN | MUTED | RESET | MUTED |

Table 1 shows examples of the effects of the sustain pedal. Referring to Table 1, during time periods 1-6 the sustain pedal is in the 'up' position, i.e. the pedal is not depressed. In time period 1, no string is being played. There is not string vibration, and the fret contact circuit is open, since no strings are fretted. The string vibration mute function (SV1 mute function) is activated, that is, in muted mode. The sampler used to create the synthetic is in standby status and the output signal is muted.

In time period 2, a string is fretted, so the string vibration is in the attack stage and the fret contact circuit is closed. Fret circuit closure un-mutes the signal from the string and the string signal is passed to the output. In time period 3, the string is still held against the fret, and the string vibration is in the decay stage.

In time period 4, the string is still held against the fret, and the string vibration is in the sustain stage, but since the sustain pedal is still up, only the string signal is passed to the output.

In time period 5, the string is released, which opens the fret contact circuit and causes further outputs to be muted.

In time period 6, there is no further finger action. Although residual open string vibration may exist, it is muted.

Time periods 10-24, show a similar scenario but with the sustain pedal depressed. The pedal is depressed in time period 10, which resets the sampler. Time periods 11-13 mimic time periods 2-4 described above and only the string vibration signal is passed to the output.

In time period 13, the sampler samples a portion of the string vibration signal.

In time period 14, as the string vibration decays, the sampled string vibration signal is played out in a loop. The output signal is gradually blended to a mixture of the string vibration signal and sampler loop output (the synthesized signal). In time period 15, the string vibration signal decreases farther (a natural or electronically-forced fade) and the output becomes equal to the sampler loop output signal only.

In time period 16, the finger is lifted from the string and the gradually decreasing sampler output continues. This continues through time period 17. In time periods 18-24 the process in time periods 11-17 is repeated, with sampler being reset in time period 18 (triggered by a subsequent fretting the string). In time period 25, the sustain pedal is lifted or released. The sampler loop output enters a release stage of more rapid amplitude reduction. After the release stage, in time period 25, the sampler may be reset.

In time periods 30-40, the process in repeated, but in this example the sustain pedal in not depressed until time period 33. This is during the sustain period of a note, so the sampler is activated to sample the string vibration signal. Also, at time period 35 a brief pedal release is introduced, during which the output signal quickly toggles from sampler to SV1 and back again to sampler.

Figure 13:
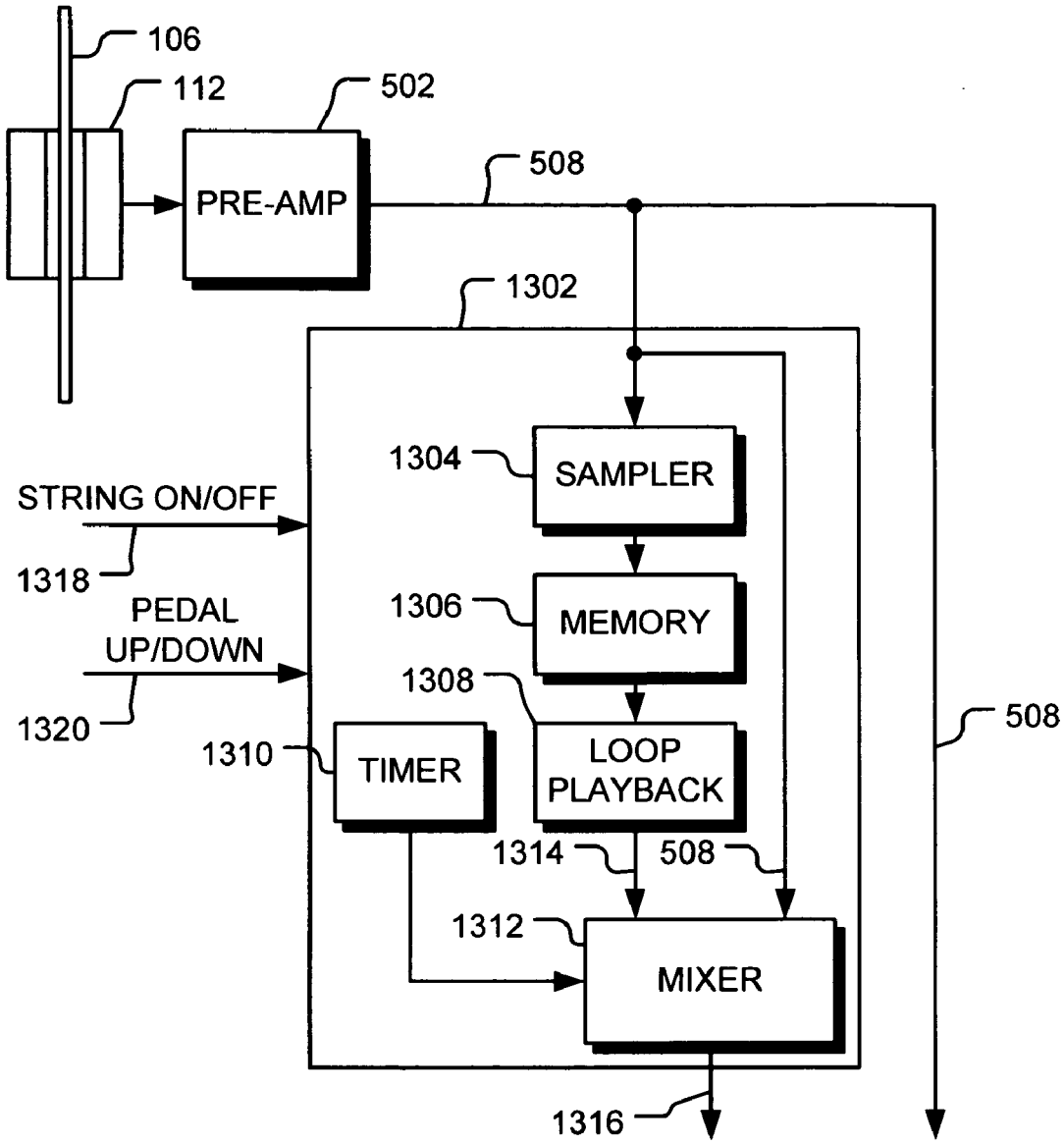
FIG. 13 is a block diagram of an electronic sustain synthesizer in accordance with certain embodiments of the invention.

FIG. 13 is a block diagram of an electronic sustain synthesizer in accordance with certain embodiments of the invention. The sustain synthesizer 1302 includes a signal sampler 1304, a memory 1306, a loop playback device 1308, a timer 1310 and a signal mixer 1312. The signal mixer 1312 takes the loop playback device output 1314 and mixes it with sensed signal 508 to produce sustained output signal 1316. In operation, vibration of a string 106 is sensed by pickup 112 and amplified in pre-amplifier 502 to produce sensed signal 508 that is supplied to the sustain synthesizer 1302. As described above with reference to table 1, operation of the sustain synthesizer 1302 is dependent upon the string status, as indicated by string on/off input signal 1318, and upon the sustain-pedal position as indicated by pedal up/down signal 1320. Timer 1310 is used to delay sampling until after the initial 'attack' and 'decay' phase of the string vibration. It is also used to control the mixing levels of the loop playback device output 1314 and sensed signal 508 as a function of time to provide the remaining desired amplitude envelope.

Figure 14:
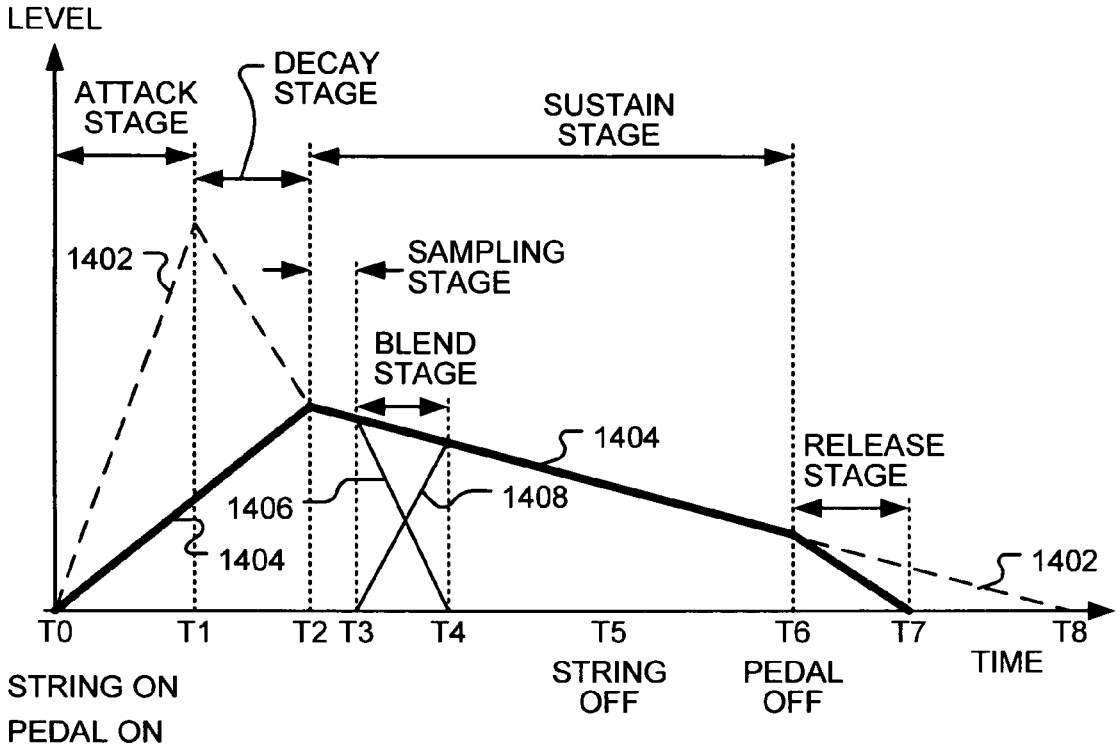
FIG. 14 is a graph of an exemplary output from an electronic muting and sustaining system in accordance with certain embodiments of the invention.

FIG. 14 is a graph of an exemplary output from an electronic muting and sustaining system in accordance with certain embodiments of the invention. Referring to FIG. 14, the vertical axis denotes the signal level (amplitude envelope) of the output while the horizontal axis denotes time. A string is fretted at time T0. The output from the pickup associated with the string is shown as broken line 1402. In the time period from T0 to T1, the string is an in 'attack stage' where the level is increasing rapidly. During the time period T1 to T2 the string is an in 'decay stage' where the level is decreasing rapidly. During the time period T2 to T8 the string is an in 'sustain stage' where the level is decreasing more slowly. At time T0 the string output is muted (attenuated) so that the system output 1404 is zero. During the time period from T0 to T2, the string output is gradually muted less, until at time T2 the full string output is used as the system output. During time period T2 to T3 the full string output is used. In this time period, transients associated with the initial playing of the string have decayed, and the string output is sampled during the time period T2 to T3. The sampled waveform is substantially periodic and may be used to generate a synthetic signal. During time period T3 to T4, a synthetic signal is generated and gradually mixed or blended with the string output. The string output component 1406 is reduced while the synthetic output component 1408 is increased proportionately so that the overall output 1404 is close to the non-muted string output. From time T4 to time T8, the system output 1404 is purely synthetic. Thus, even if the played string were released (at time T5, say) it would not affect the system output. The broken line 1402 assumes that no string release has occurred. The amplitude reduction rate of the synthetic output may be chosen to simulate the natural decay of the string or may be higher or lower. At time T6, the sustain pedal is released, and the synthetic output is reduced more rapidly during a release stage from time T6 to time T7.

The sustain effect is achieved by replacing the played note with a synthesized note that initially has the same characteristic as a played note. In this way, the synthesized note may be sounded even after the original played note has been released, or another note played. This is in contrast to prior sustain approaches, which act to modify the envelope of the played signal over time and have no output once the original note has stopped.

In one embodiment of the invention, the characteristic of the synthesized signal is slowly modified over time by reducing the levels of the harmonic components of the signals. This increases the realism of the synthetic note.

Synthesis of musical notes is well known and a synthetic note may be generated by any of a number of methods known to those of ordinary skill in the art. Examples include waveform synthesis, FM synthesis and frequency synthesis. However, in a music synthesizer the characteristic of the note is programmed in advance. In the present invention, the initial part of sustained note is the actual note sensed from a musical instrument, such as a guitar or other stringed instrument, while the latter part of the sustained note is obtained by synthesis, with the synthesized note initially having the same characteristic as the played note. For example, the harmonic content, phase and amplitude of the initial synthetic note match that of the played note so that the synthetic note is indistinguishable from the actual played note.

In accordance with an embodiment of the invention, the duration of a sensed signal, corresponding to a note played on a musical instrument, is artificially extended.

During a first time interval the sensed signal is output and a set of characteristics of the sensed signal is identified and stored. During a second time interval, following the first time interval, a synthetic signal is generated, the set of characteristics of the synthesized signal initially being substantially the same as the set of characteristics of the sensed signal. During the second time interval the synthetic signal is output and the harmonic components of the synthetic signal is gradually reduced to simulate a real sustained note. The overall level may also be reduced.

Storing a set of characteristics of the sensed signal may be achieved by storing at least one cycle of the sensed signal in a waveform memory.

Synthesizing a synthetic signal may be achieved by combining one or more waveform values from the waveform memory.

In a further embodiment, storing a set of characteristics of the sensed signal may be achieved by identifying and storing the frequency components of the played signal.

Gradually reducing the harmonic components of the synthetic signal may be achieved by filtering the synthetic signal to produce a filtered signal; and refreshing the waveform memory with the filtered signal. The filter may have a low-pass characteristic, for example.

The set of characteristics of the sensed signal may include the position of the sensed signal within its repeat cycle. This information allows for a smooth transition between the sensed signal and the synthesized signal.

By way of explanation, sustain using waveform synthesis is described in more detail below. However, it will be apparent to those of ordinary skill in the art that other forms of synthesis may be used. For example, the phase and amplitude of the harmonic frequency components of the played note may be identified and used to generate the synthetic note as a weighted sum of sine and cosine signals. The weights applied to the harmonic components may be reduced, or otherwise modified, over time.

Figure 15:
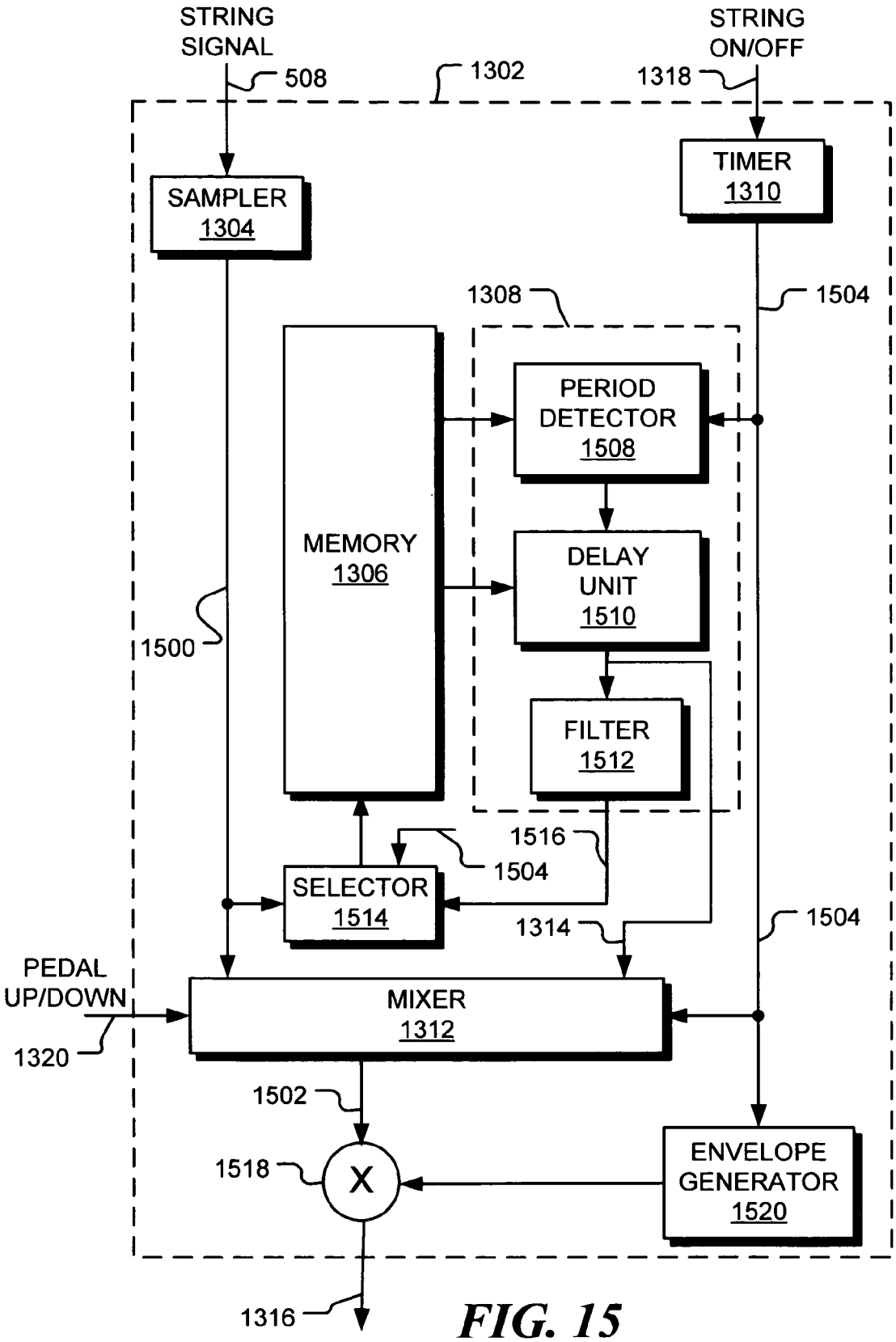
FIG. 15 is a diagram of an exemplary sustain synthesizer in accordance with certain embodiments of the invention.

FIG. 15 is a diagram of an exemplary sustain synthesizer 1302. The sustain synthesizer 1302 includes a signal sampler 1304, a waveform memory 1306, a loop playback device 1308, a timer 1310 and a signal mixer 1312. The signal mixer 1312 takes the output 1314 from the loop playback device and mixes it with sampled version 1500 of the sensed signal 508 to produce mixed output signal 1502. Mixed output signal 1502 is a weighted sum of the playback device output 1314 and the sampled version of the sensed signal 508. Either signal may be output individually, which is equivalent to weightings of unity and zero. The weightings may be varied over time, as depicted by the timing signal 1504 input to mixer 1312, and may be dependent upon other inputs to the sustain synthesizer, such as the sustain pedal up/down signal 1320 or the string on/off signal 1318.

When a note is first played, it is selected by selector 1514 and stored in the sample memory 1306. The memory may be implemented as a delay line, a First In, First Out (FIFO) buffer or a circular buffer, for example.

If the fundamental period (or fundamental frequency) of the note played is not known by some other means, a period detector 1508 is used to determine the period of the played note. The period detector 1502 may use one or more techniques known in the art, such as detection of zero-crossings in the sensed signal, calculation of the minimum absolute or squared difference between a current signal and prior signals over a number of different time lags, or calculation of a Fourier transform of the signal. The calculation may be made for a prescribed period of time after a note is first played. If prior samples are used in the calculation the period detector may access the sample memory 1306.

Once the period is known, a synthetic output signal may be generated if desired (for example, if the sustain pedal is depressed). A delay unit 1510 generates an estimate of the played signal by accessing the sample memory 1306. In each sample period, the position within the repeat cycle (i.e. the phase of the signal) is updated and a corresponding memory location in the sample memory 1306 is accessed. The position need not be an integer number of samples, since the delay unit may use one of more samples from the memory 1306 to estimate the signal with the correct phase. A recursive or non-recursive interpolation between samples may be used, for example.

In one embodiment, the signal, $y_{new}$, N+g samples prior (where N is an integer and $0 \leqq g < 1$) is estimated as $y_{new} = x(N) + h \times (x(N-1) - y_{old})$, where the filter coefficient is $h = (1-g)/(1+g)$, and x is a value from the sample memory.

At each sample time, the position within the cycle (the phase) is changed by an amount related to the repeat period of the note (or, equivalently, its fundamental frequency) and the sampling rate. The repeat period, and hence the change in position, may be adjusted over time as the synthesized signal is outputted. This feature may be used to adjust the frequency of the synthesized note. For example, the synthesized note may be adjusted to the perfect pitch over a period of time, or the frequency may be modulated, or the frequency may be adjusted in response to a 'note bend' input (such as a pitch wheel, joystick, or string tension sensor).

The delayed signal output from delay unit 1510 is passed to a filter unit 1512, and to mixer 1312 as the synthetic signal.

The selector 1514 determines which of the sampled sensed signal 1500 and the filtered synthetic signal 1516 is used to update the sample memory 1306. When a note is first played, as indicated by the timer signal 1504, the sensed signal 1500 is used to update the memory 1306. When the note is being synthesized, the filtered synthetic signal 1516 is used to update the memory 1306. When the note is not sustained, as indicated by the position of the sustain pedal, the played note is used to refresh the memory 1306.

Since the synthetic signal is computed from the memory, this forms a feedback loop involving elements 1306, 1510 and 1512. In one embodiment, the filter 1512 has a low-pass characteristic. Each time a signal passes around the feedback loop, the higher frequency components are increasingly suppressed. Since harmonic components of the signal at higher frequencies than the fundamental frequency of the signal, the harmonic components of the signal are gradually suppressed. This mimics the characteristic of a real sustained note from a stringed instrument.

In one embodiment, the new filtered signal $yf_{new}$, is calculated from the previous filtered signal, $yf_{old}$, as $yf_{new} = Yf_{old} + c \times (y - yf_{old})$, where c is a filter coefficient and y is the input to the filter.

In FIG. 15, the filter 1512 is placed between the delay unit 1510 and the mixer 1312. However, it will be apparent to those of ordinary skill in the art that the filter may be placed at any position in the feedback loop.

In one embodiment, the mixer 1312 comprises a selector switch which selects between the sampled sensed signal 1500, the synthetic signal 1314, and no output (mute). This corresponds to using the binary weightings 0 and 1. In this embodiment, the mixer 1312 and the selector 1514 may be combined.

The level of the signal from the mixer 1312 may be adjusted in level adjuster 1518. The level is set by an envelope generator 1520 that adjusts the level dependent upon the time since the note was first played as indicated by the timer signal 1504 from timer 1310, and, optionally, dependent upon the position of the sustain pedal.

The sustain synthesizer 1302 may be implemented on a custom or general digital signal processing circuit that executes a sequence of program instructions.

Figure 16:
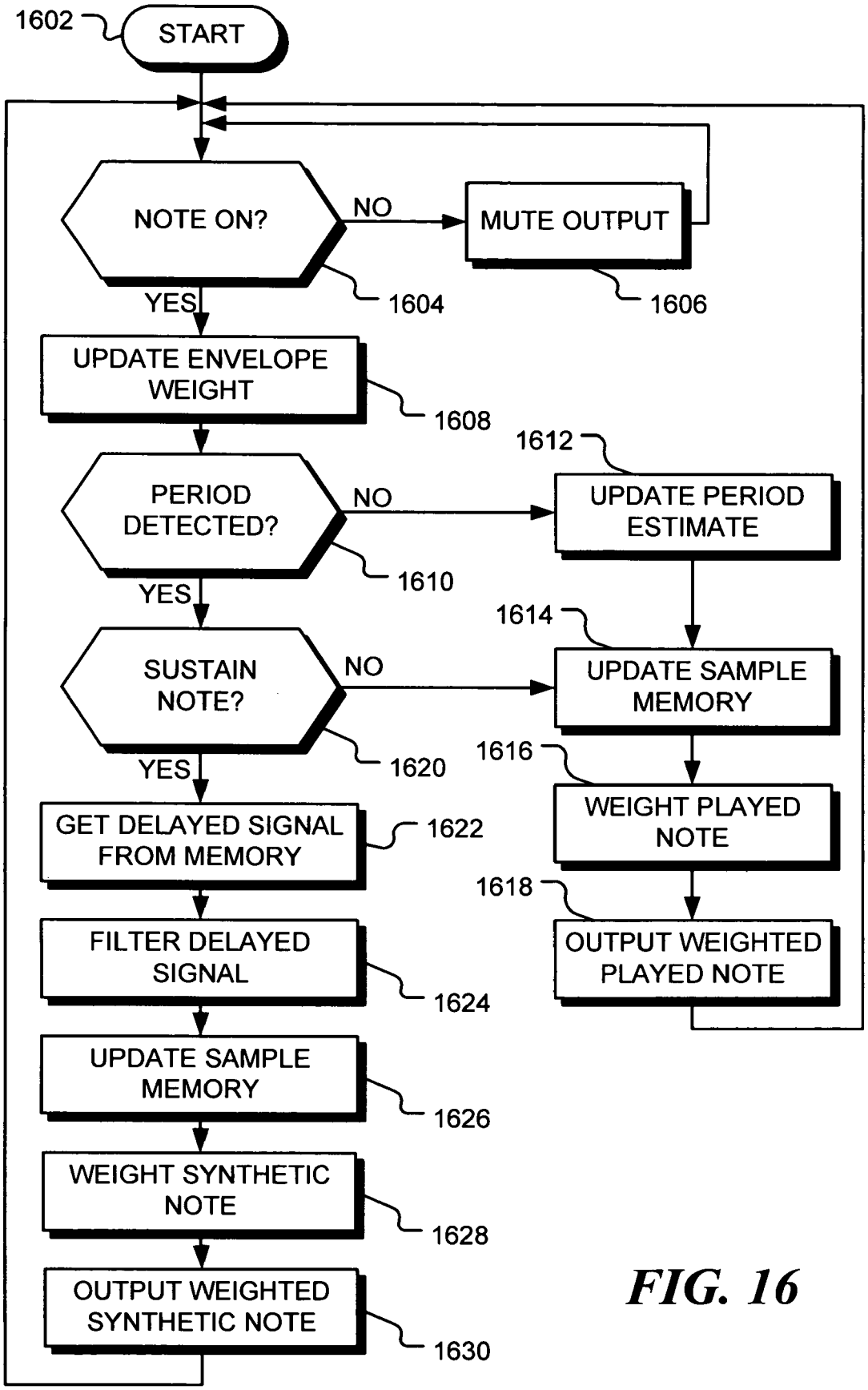
FIG. 16 is a flow chart of a method for sustaining a note played on an instrument in accordance with certain embodiments of the invention.

FIG. 16 is a flow chart of a method for sustaining a note played on an instrument. The instrument may be any type of instrument. In particular, the instrument may be a stringed instrument such as a guitar that is plucked or strummed, or a tapping instrument as described herein. Following start block 1602 in FIG. 16, the onset of a note is detected at block 1604. If no note has been played, as depicted by the negative branch from block 1604, the output may be muted at block 1606 and flow returns to decision block 1604. The muting process may take place over a period of time in which the output level is gradually reduced. If a note has been sounded, as depicted by the positive output from decision block 1604, the envelope weight is updated at block 1608. This weight may depend upon whether the note is to be sustained or not. If the period of the note has not yet been detected, as determined by the negative branch from decision block 1610, the period calculation is continued at block 1612. If the period has not been detected, or if the note is not to be sustained (as determined by the negative branch from decision block 1620) the sampled version of the sensed (played) note is stored in the sample memory at block 1614, the note is weighted by the envelope weight at block 1616 and the weighted note is output at block 1618.

If the period has been detected and the note is to be sustained, as depicted by the positive branch from decision block 1620, a synthetic note is generated. First, a delayed signal is retrieved from the memory at block 1622. This may be computed from one or more samples from the memory. The delayed signal is filtered at block 1624 and stored back to the memory at block 1626. In this manner the memory is continually refreshed with the filtered version of the output samples, and the sampled sensed signal is replaced with the synthesized signal. The filter may be a low pass filter that has the effect of gradually removing harmonic components from the stored signal. This increases the realism of the synthesized signal. Either the delayed signal or the filtered signal may be used as the synthesized note.

At block 1628 the synthetic note is weighted by the envelope weight and the weighted synthetic note is output at block 1630. Flow then returns to block 1604.

In a further embodiment, once a pedal-off event is detected, the envelope weight is reduced to zero over a period of time.

While the invention has been described in conjunction with specific embodiments, it is evident that many alternatives, modifications, permutations and variations will become apparent to those of ordinary skill in the art in light of the foregoing description. Accordingly, it is intended that the present invention embrace all such alternatives, modifications and variations as fall within the scope of the appended claims.

What is claimed is:

1. A sustain synthesizer for artificially extending the duration of a sensed signal corresponding to a note played on a musical instrument, the sustain synthesizer comprising:

a first input for receiving the sensed signal;

a memory for storing a waveform; and a loop playback unit operable to access the memory and produce a synthesized signal, the loop playback unit having a loop time dependent upon the repeat period of the note, and a mixer operable to produce a sustained signal that comprises the sensed signal during an initial time period and comprises the synthesized signal during a later time period, wherein the synthesized signal is dependent upon the phase, amplitude and harmonic content of the note during the initial time period, and has a varying harmonic content in the later time period.

2. A sustain synthesizer in accordance with claim 1, wherein the loop playback unit comprises:

a delay unit operable to retrieve at least one waveform value from the memory and produce the synthesized signal; and a filter operable to filter the synthesized signal to produce a filtered signal, wherein during the initial time period the sensed signal is used to refresh the memory and during the later time period the filtered signal is used to refresh the memory.

3. A sustain synthesizer in accordance with claim 1, further comprising:

an envelope generator, operable to produce an envelope value; and a level adjuster operable to adjust the level of the sustained signal dependent upon the envelope value.

4. A sustain synthesizer in accordance with claim 1, further comprising:

a means for detecting when a note is played.

5. A sustain synthesizer in accordance with claim 1, further comprising:

a third input for receiving a signal from a sustain control switch, wherein the mixer operates to output the sensed signal if the sustain control switch is not depressed while a note is played.

6. A sustain synthesizer for artificially extending the duration of a sensed signal corresponding to a note played on a musical instrument, the sustain synthesizer comprising:

a first input for receiving the sensed signal; a memory for storing a waveform;

a loop playback unit operable to access the memory and produce a synthesized signal, the loop playback unit comprising:

a delay unit operable to retrieve at least one waveform value from the memory and produce the synthesized signal, and a filter operable to filter the synthesized signal to produce a filtered signal, a mixer operable to combine the synthesized signal and the sensed signal to produce a sustained signal, and a period detector for detecting the repeat period of the sensed note, wherein the delay unit retrieves at least one waveform value from the memory dependent upon the repeat period, and wherein during an initial time period the sensed signal is used to refresh the memory and during a later time period the filtered signal is used to refresh the memory.

7. A sustain synthesizer in accordance with claim 6, wherein the mixer outputs the sensed signal during the initial time period and outputs the synthesized signal during the later time period.

8. A sustain synthesizer for artificially extending the duration of a sensed signal corresponding to a note played on a musical instrument, the sustain synthesizer comprising:

a first input for receiving the sensed signal;

a memory for storing a waveform;

a loop playback unit operable to access the memory and produce a synthesized signal;

a mixer operable to combine the synthesized signal and the sensed signal to produce a sustained signal;

an envelope generator, operable to produce an envelope value; and a level adjuster operable to adjust the level of the sustained signal dependent upon the envelope value;

a second input for receiving a note-on signal indicative of whether a note is played or not; and a timer, operable to produce a timer value indicative of the time since a note-on signal was received, wherein the envelope generator is responsive to the time value.

9. A sustain synthesizer in accordance with claim 8, wherein the envelope value is decreased to zero in response to a note-off signal unless the note is to be sustained.

10. A method for artificially extending the duration of a sensed signal corresponding to a note played on a musical instrument, the method comprising:

during a first time interval within the duration of the note:

outputting the sensed signal; and storing a set of characteristics of the sensed signal the set of characteristics relating to the phase, amplitude and harmonic content of the note; and during a second time interval, following the first time interval and beginning within the duration of the note:

synthesizing a synthetic signal, the set of characteristics of the synthesized signal initially being substantially the same as the set of characteristics of the sensed signal;

outputting the synthetic signal; and gradually reducing the harmonic components of the synthetic signal.

11. A method in accordance with claim 10, wherein storing a set of characteristics of the sensed signal comprises storing at least one cycle of the sensed signal in a waveform memory.

12. A method in accordance with claim 11, wherein synthesizing a synthetic signal comprises combining one or more waveform values from the waveform memory.

13. A method in accordance with claim 11, wherein the set of characteristics of the sensed signal includes the position of the sensed signal within its repeat cycle.

14. A method for artificially extending the duration of a sensed signal corresponding to a note played on a musical instrument, the method comprising:

during a first time interval:

outputting the sensed signal; and storing a set of characteristics of the sensed signal; and during a second time interval, following the first time interval:

synthesizing a synthetic signal, the set of characteristics of the synthesized signal initially being substantially the same as the set of characteristics of the sensed signal;

outputting the synthetic signal; and gradually reducing the harmonic components of the synthetic signal, wherein storing a set of characteristics of the sensed signal comprises storing at least one cycle of the sensed signal in a waveform memory, and wherein gradually reducing the harmonic components of the synthetic signal comprises:

filtering the synthetic signal through a filter with a low-pass characteristic to produce a filtered signal; and refreshing the waveform memory with the filtered signal.

15. A method for artificially extending the duration of a sensed signal corresponding to a note played on a musical instrument, the method comprising:

during a first time interval:

outputting the sensed signal; and storing a set of characteristics of the sensed signal: and during a second time interval, following the first time interval:

synthesizing a synthetic signal, the set of characteristics of the synthesized signal initially being substantially the same as the set of characteristics of the sensed signal;

outputting the synthetic signal; and gradually reducing the harmonic components of the synthetic signal, wherein storing a set of characteristics of the sensed signal comprises storing at least one cycle of the sensed signal in a waveform memory, and wherein the position of the sensed signal within its repeat cycle is adjusted over time in accordance with a desired frequency of the sustained signal.

16. A method in accordance with claim 15, wherein the desired frequency of the sustained signal is adjusted over time.

17. A method for electronically sustaining a sensed string vibration signal of a musical instrument having a plurality of strings, the method comprising:

detecting the pitch and harmonic components of the sensed string vibration signal;

generating a synthesized signal initially having the same pitch and harmonic components as the sensed string vibration signal;

electronically combining the sensed string vibration signal with the synthesized signal whenever a sustain control switch is activated to produce a combined signal;

decreasing the amplitude of higher harmonic components of the synthesized signal faster than the lower harmonic components of the synthesized signal, and decreasing the amplitude of the combined signal over a 'release' time period once the sustain control switch is deactivated.

18. A method in accordance with claim 17, further comprising varying the length of the release time period in response to a user interface.

19. A method in accordance with claim 17, wherein a foot pedal activates and deactivates the sustain control switch.

20. A method in accordance with claim 17 wherein detecting the pitch and harmonic components of the sensed string vibration signal comprises:

detecting periodic components in the sensed string vibration signal.

21. A method in accordance with claim 17, wherein the amplitude of the combined signal decreases with time when the sustain control switch is activated.

22. A method in accordance with claim 17, wherein said plurality of strings is tuned such that the pitches of adjacent strings differ by one whole tone.

23. A method in accordance with claim 17, wherein the musical instrument comprises a guitar.

* * * * *